United States Patent [19]

Ripstein

[11] 4,285,088

[45] Aug. 25, 1981

[54] BRUSH AND PROCESS FOR ITS MANUFACTURE

[76] Inventor: Jorge V. Ripstein, Av. Cuauhtemoc 60 Desp. 304, Mexico City, Mexico, 7

[21] Appl. No.: 966,024

[22] Filed: Dec. 4, 1978

[51] Int. Cl.[3] ..... A46B 1/00

[52] U.S. Cl. ..... 15/193; 300/2

[58] Field of Search ..... 15/191–193, 15/194, 202; 300/21

[56] References Cited

U.S. PATENT DOCUMENTS

| | | | |
|---|---|---|---|
| 1,436,916 | 11/1922 | Shulman et al. | 15/193 X |
| 2,488,865 | 11/1949 | Haux | 300/21 |
| 2,763,884 | 9/1956 | Fritz | 15/176 |
| 2,785,427 | 3/1957 | Bury | 15/202 |
| 2,854,684 | 10/1958 | Hardman et al. | 300/21 X |
| 3,386,119 | 6/1968 | Shulman | 300/21 X |
| 3,799,616 | 3/1974 | Lewis, Jr. | 300/21 X |
| 3,910,637 | 10/1975 | Lewis, Jr. | 300/21 X |
| 4,009,910 | 3/1977 | Lewis, Jr. | 300/21 X |

FOREIGN PATENT DOCUMENTS

| | | | |
|---|---|---|---|
| 704590 | 2/1954 | United Kingdom | 300/21 |

*Primary Examiner*—Harvey C. Hornsby
*Assistant Examiner*—Arthur O. Henderson
*Attorney, Agent, or Firm*—Hopgood, Calimafde, Kalil, Blaustein & Judlowe

[57] ABSTRACT

There is disclosed a process for manufacturing a body of fibers for use in a brush as well as the brush so produced. This process comprises inserting a plurality of fibers into an opening of a plate, separating the fibers into a plurality of fiber bunches or curtains, applying an adhesive to the end of the fibers which is at the base of the plate, and removing the body of fibers from the plate, such that the body of fibers contains at least one parallel space or passage between the curtains of fibers. The body of fibers is then inserted into a brush handle. This brush may be used to apply coating liquids such as paints and varnishes.

9 Claims, 13 Drawing Figures

BRUSH AND PROCESS FOR ITS MANUFACTURE

BACKGROUND OF THE INVENTION

This invention relates generally to brushes such as paint brushes and methods for their manufacture.

Paint brushes which can hold relatively large amounts of paint, varnish, or other coating liquid without dripping are desirable since a painter would not have to place such a brush into the coating liquid as often as he would have to with the same size brush which held comparatively smaller amounts of coating liquid. The amount of coating liquid that can be retained by a paint brush is dependent upon the size, number and location of the passages or spaces within the fibers of the brush.

It is also advantageous to manufacture a paint brush such that the means for fastening the brush fibers within the brush handle are included within and form a unitary construction with the brush handle.

OBJECTS AND SUMMARY OF THE INVENTION

Accordingly, it is a general object of the present invention to provide a brush which has passages or spaces located within the fibers of the brush.

Another object of the present invention is to provide a process for manufacturing such a brush.

A more specific object of the present invention is to provide a paint brush which contains passages or spaces within the fibers of the brush such that the brush can hold a relatively large amount of coating liquid without substantial dripping.

Still another object of the present invention is to provide a process for preparing a paint brush which can hold a relatively large amount of coating liquid without substantial dripping.

Other objects and advantages of the present invention will be apparent to those skilled in this art from the following summary of the invention and description of its preferred embodiments.

In one aspect, the present invention provides a process for manufacturing a body of fibers for use in a brush. This process comprises:

(a) inserting lengthwise a plurality of fibers into the elongated opening of a plate such that said fibers are tightly held within said opening;

(b) separating the fibers into a plurality of curtains by inserting separation means into the ends of these fibers, the ends being opposite from the ends which are inserted in the plate, the separation means causing the body of fibers to be separated by at least one space or passage between the curtains of fibers, the separation distance being such that substantial dripping of the coating liquid does not take place;

(c) maintaining the separation means within the fibers while applying to the ends of the fibers which are at the base of the plate means for adhering substantially all of the fibers into a body of fibers;

(d) removing the separation means from the body of fibers, and (e) removing the body of fibers from the plate such that the body of fibers contains at least one space or passage between the curtains of fibers.

In another aspect, the present invention provides the body of fibers prepared according to the above process.

In still another aspect, the present invention provides a process for manufacturing a brush such as that which may be used to coat liquids, comprising attaching the body of fibers to a brush handle by pressing the body into the cavity which is within the brush handle.

In yet another aspect, the present invention provides the brush prepared according to the above described process.

DESCRIPTION OF THE PREFERRED EMBODIMENTS

Figure 1:
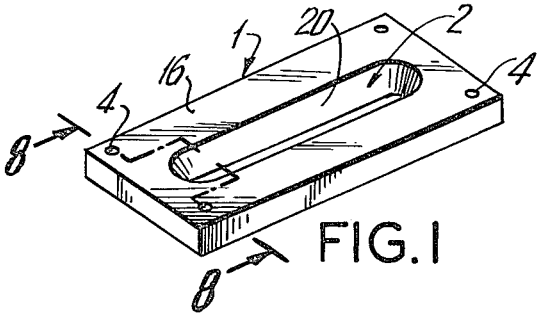
FIGS. 1 to 7 illustrate the various steps used in manufacturing the brushes of the present invention.

The brush is manufactured by first inserting lengthwise a plurality of fibers into the elongated opening of a plate. The fibers or bristles used in the present invention may be either natural fibers, such as camel hair or synthetic fibers, such as nylon or polyethylene terephthalate. Mixtures of two or more fibers may also be used. Such fibers are well known to those skilled in the art. The plate into which the fibers are inserted may be made of any material, such as wood, metal, or other materials which would not be adversely affected by the application of the adhesive which will be described hereinbelow. Such materials are well known to those skilled in this art.

The plate height should be high enough to hold substantially all of the fibers together during the manufacturing process.

The opening which is in the plate has an elongated shape when viewed from above, i.e., it may be in the shape of a rectangle which has its corners rounded off, or it may be oval shaped. The exact size and shape of the opening may vary according to the desired size and shape of the brush. In a preferred embodiment, the elongated opening has a smaller perimeter at its base than it does at its top so that the body of fibers which is eventually formed may be readily ejected from the plate.

In a preferred embodiment, the plate contains a plurality of holes through which guides (which are attached to the means for ejecting the body of fibers from the plate ) may be inserted in order to facilitate the removal of the body of the fibers from the plate.

After insertion into the plate, the fibers are then separated into a plurality of substantially planar bunches or curtains by inserting separation means into the end of the fibers which is opposite from the end which is inserted in the plate. The separation means may be any means known to those skilled in this art for separating the fibers into curtains with a space or passage between each curtain of fibers. When more than two curtains of fibers are formed by plural separation means, the plurality of spaces or passages are parallel to one another. The separation means may be made of any solid material suitable for carrying out the separation function. Such materials are well known to those skilled in the art and include wood and metal.

The separation means are placed into the body of fibers up to the top of plate 1.

In a preferred embodiment, the separation means is a comb which has a board tooth with a blunt edge or end. The comb may contain two or more such board teeth depending upon the desired number of parallel spaces or passages. The comb is inserted into the body of fibers through a side of the body of fibers.

The width of the separation distance may be up to but not including the distance at which there occurs substantial drippig of coating liquid which may be applied to these fibers. Since dripping of the coating liquid depends, in part, upon the viscosity of the coating liquid, the maximum size of the space or passage will differ depending upon the particular liquid which is to be coated.

Means for adhering substantially all the fibers into a body of fibers is then applied to the end of the fibers which is at the base of the plate. Such adhering means includes adhesives which are well known to those skilled in this art, such as, phenolic adhesives, epoxy adhesives, or animal glue.

The separation means are maintained within the fibers while the adhesive is applied and until it dries and/or sets. The body of fibers is then removed from the plate. The body of fibers may be removed from the plate by any means known to those skilled in this art, but, in a preferred embodiment, the body of fibers is removed by employing ejector means, which comprise a male punch for pushing the body of fibers out of the oval opening of the plate and guides which may be inserted through the holes in the plate so as to effect a better ejection of the body of fibers.

The separatin means may be removed from the body of fibers at any time after the adhesive has dried, either prior to or after ejection of the body of fibers from the plate. After removal of the separation means, at least one space or passage is defined within the body of fibers.

The body of fibers is then placed into the cavity of the brush handle. This cavity contains fastening means for holding the body of fibers within the brush handle. The fasteners may be any means known to those skilled in the art but, in a preferred embodiment, are arrow shaped projections which are incorporated within the cavity as a unitary part of the brush handle.

A preferred embodiment for carrying out the process of the present invention is described by means of FIGS. 1 through 7. FIG. 1 illustrates plate 1 having an elongated opening 2 with holes 4 for receiving the guides from the ejector means. FIG. 8 illustrates a cross-sectional side view of plate 1 having inner walls 20 inclined or angled such that the opening has a smaller perimeter at base 17 than it does at top 16.

Figure 2:
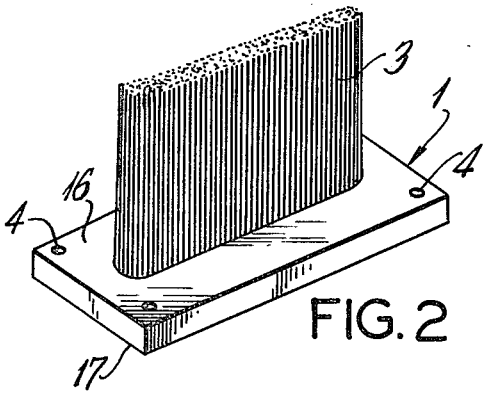
Figure 6:
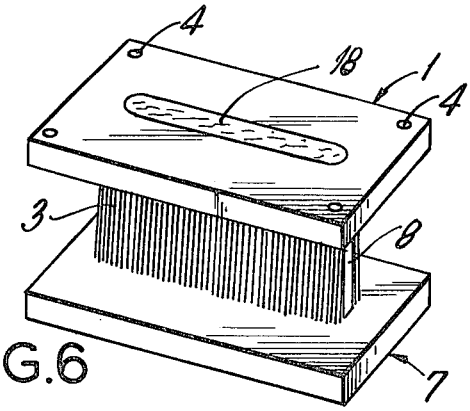

The fibers are inserted through the top 16 of plate 1 as shown in FIG. 2 and arranged such that the ends of the fibers are substantially all even with flat base 17.

Figure 3:
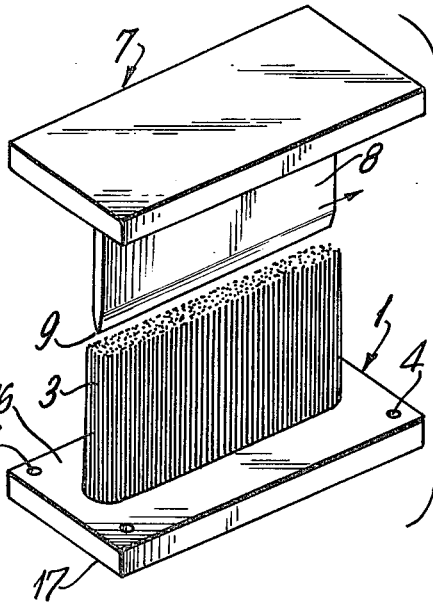
Figure 4:
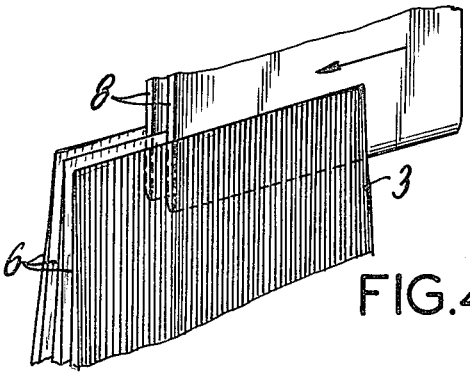

FIG. 3 illustrates the separation means (which comprise a comb 7 with a single board tooth 8, with blunt edge or end 9) about to be inserted into fibers 3. FIG. 4 illustrates the use of two board teeth 8 being inserted through the side of fibers 3 and the separation of the fibers into the three fiber curtains 6.

Figure 5:
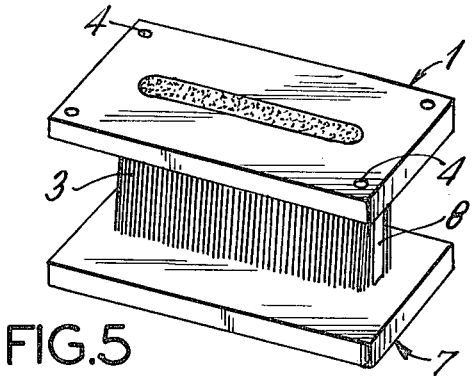

FIG. 5 illustrates plate 1 with fibers 3 inserted therein. Separation means comprising comb 7 and board tooth 8 are inserted into fibers 3. An adhesive such as an epoxy adhesive is applied at the ends of fibers 3 which are contained within plate 1. The separation means are contained within the fibers while the adhesive dries or sets. The dried adhesive 18 forms the fibers into a single body of fibers. The separation means are then removed from the fibers.

Figure 7:
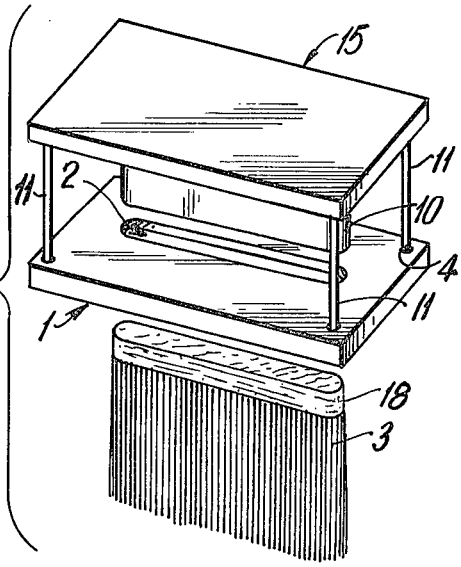
Figure 8:
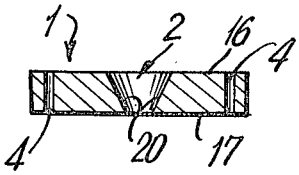
FIG. 8 is a cross-section of the plate taken along lines 8—8 of FIG. 1.
Figure 9:
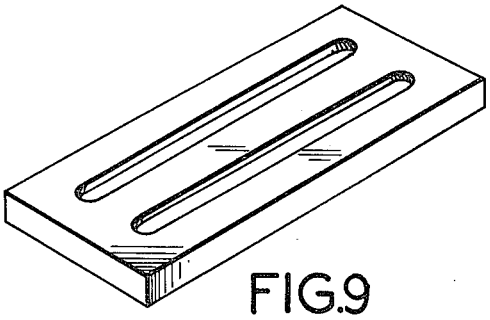
FIGS. 9 and 10 illustrate plates which may be used in mass producing the brushes of the present invention.
Figure 10:
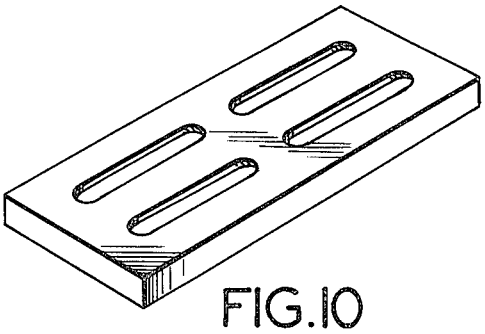

FIG. 7 illustrates the ejector means 15 (which comprise male punch 10 and guides 11) being used to eject fibers 3 from plate 1 by contacting the ends of fibers 3 which are contained within plate 1 with the male punch 10 and exerting pressure through the ejector means to the fibers to eject the fiber body from plate 1. Guides 11 are placed into holes 4 in order to effect a better ejection of fibers 3.

Figure 11:
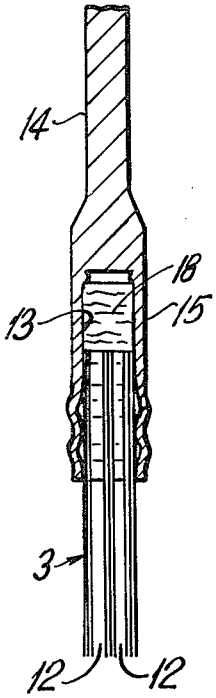
FIG. 11 illustrates a sectional side view of the body of fibers attached to a brush handle.
Figure 12:
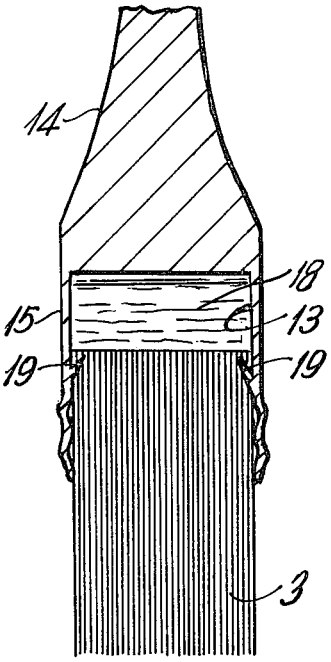
FIG. 12 illustrates another sectional view of the body of fibers attached to the brush handle.
Figure 13:
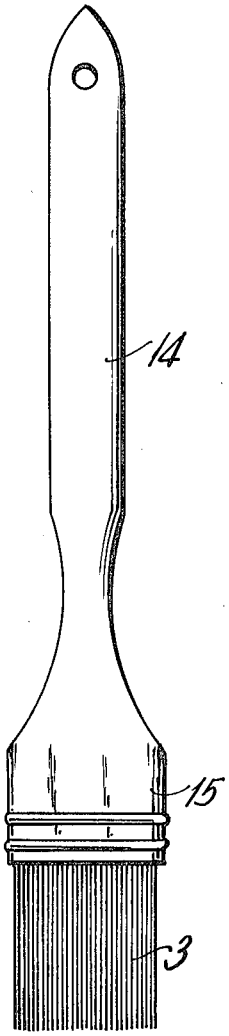
FIG. 13 is an elevational view of the entire brush including the brush handle.

As illustrated in FIG. 11, the fibers 3 are then pressed into cavity 13. The fibers contain at least one space or passage 12. In FIG. 11 two such spaces or passages are illustrated. The fiber body is held within cavity 13 by arrow shaped projections 19 which are formed as a unitary piece with hollow handle 14, thus looking like outside sleeve 15 which forms an integral part of handle 14, as illustrated by FIGS. 12 and 13.

The present invention thus produces a body of fibers adapted to be incorporated in a brush whcih may be used to apply coating liquids. The body of fibers is substantially all connected to one another at one end by adhesive means. The body of fibers comprises an adhesively bonded fiber portion, with a plurality of fiber curtains extending therefrom, each of said curtains being separated from its adjacent curtain by a distance which is such that substantial dripping of the coating liquid does not take place. The curtains are spaced substantially parallel with respect to one another.

Furthermore, this process produces a brush for applying coating liquids comprising the above described body of fibers and a brush handle which contains a cavity for receipt of the body of fibers. The body of fibers are fastened within the cavity by arrow shaped projections which are formed as a unitary piece with the brush handle.

Although the present invention has been described in conjunction with preferred embodiments, it is to be understood that modifications and variations may be resorted to without departing from the spirit and scope of the invention, as those skilled in the art will readily understand. These modifications and variations are considered to be within the purview and scope of the invention and the appended claims.

I claim:

1. A process for manufacturing a body of fibers for use in a brush for applying a coating liquid to a surface, which process comprises (a) inserting lengthwise a plurality of fibers into the elongated opening of a plate such that said fibers are tightly held within said opening, (b) separating said fibers into a plurality of curtains by inserting separation means into the end of said fibers, said end being opposite from the end which is inserted in said plate, said separation means causing said body of fibers to be separated by at least one space or passage between said curtains of fibers, said separation distance being such that substantial dripping of said coating liquid does not take place, (c) maintaining said separation means within said fibers while applying to the ends of said fibers which are at the base of said plate means for adhering substantially all of said fibers into a body of fibers, (d) removing said separation means from said body of fibers, and (e) removing said body of fibers from said plate, such that said body of fibers contains at least one space or passage between said curtains of fibers.

2. The process of claim 1 wherein the shape of said opening is such that the opening has a smaller perimeter at its base than at its top.

3. The process of claim 1 wherein said plate contains a plurality of elongated openings.

4. The process of claim 1 wherein said separation means comprise a comb with at least one board tooth having a blunt edge or end.

5. The process of claim 4 wherein said comb comprises a plurality of board teeth.

6. The process of claim 1 wherein said body of fibers is removed by employing ejector means which comprise a male punch for pushing said body of fibers out of said elongated opening of said plate and guide means which may be inserted through holes which are contained in said plate so as to effect a better ejection of the fibers.

7. The process of claim 1 wherein said body of fibers is inserted within a cavity which is contained within a brush handle, said cavity containing fastening means for holding said body of fibers within said brush handle.

8. The process of claim 7 wherein said fastening means are arrow shaped projections which are incorporated within said cavity.

9. A process for manufacturing a paint brush comprising (a) inserting lengthwise a plurality of fibers into the elongated opening of a plate, such that said fibers are slightly held within said opening, said opening being such that it has a smaller perimeter at its base than at its top, (b) separating said fibers into a plurality of curtains by inserting separation means into the end of said fibers, said end being opposite from the end which is inserted in said plate, said separation means comprising a comb with at least one board tooth having a blunt edge or end, and said separation means causing said body of fibers to be separated by at least one space or passage between said curtains of fibers, said separation distance being such that substantial dripping of said coating liquid does not take place, (c) maintaining said separation means within said fibers while applying to the ends of said fibers which are at the base of said plate means for adhering substantially all of said fibers into a body of fibers, (d) removing said separation means from said body of fibers, (e) removing said body of fibers from said plate by pressing said body with ejector means which comprise a male punch for pushing said body of fibers out of said elongated opening of said plate and guide means which may be inserted through holes which are contained in said plate, such that said body of fibers contains at least one space or passage between said curtains of fibers, and (f) inserting said body of fibers within a cavity which is contained within a brush handle, said cavity containing arrow shaped projections for holding said body of fibers within said cavity.

* * * * *